US007013853B2

(12) United States Patent
Asami et al.

(10) Patent No.: US 7,013,853 B2
(45) Date of Patent: Mar. 21, 2006

(54) VALVE CONTROL SYSTEM FOR INTERNAL COMBUSTION ENGINE

(75) Inventors: Kiyoshi Asami, Saitama-ken (JP); Shigetaka Kuroda, Saitama-ken (JP); Hiroshi Murakami, Saitama-ken (JP); Takashi Kamimura, Saitama-ken (JP); Naoki Tsuji, Saitama-ken (JP); Akihito Ohtsu, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 22 days.

(21) Appl. No.: 10/893,977

(22) Filed: Jul. 20, 2004

(65) Prior Publication Data

US 2005/0022761 A1 Feb. 3, 2005

(30) Foreign Application Priority Data

Jul. 28, 2003 (JP) ..... 2003/202529

(51) Int. Cl.
*F01L 1/34* (2006.01)

(52) U.S. Cl. ..... 123/90.15; 123/90.17; 123/90.31; 123/347

(58) Field of Classification Search ..... 123/90.15, 123/90.16, 90.17, 90.18, 90.27, 90.31, 322, 123/345, 347, 406.23; 477/107, 109
See application file for complete search history.

(56) References Cited

U.S. PATENT DOCUMENTS 6,352,061 B1 * 3/2002 Takahashi ..... 123/90.15
6,491,022 B1 * 12/2002 Okamoto ..... 123/396
6,718,920 B1 * 4/2004 Hoshino et al. ..... 123/90.15

* cited by examiner

*Primary Examiner*—Thomas Denion
*Assistant Examiner*—Ching Chang
(74) *Attorney, Agent, or Firm*—Westerman, Hattori, Daniels & Adrian, LLP

(57) ABSTRACT

A valve control system for an internal combustion engine, which enables the operating mode of a valve system to be switched in optimal timing while preventing the driver from feeling the switching operation so busy and at the same time securing feeling of acceleration, thereby improving drivability. A variable valve-actuating mechanism is capable of selectively switching the operating mode of a valve system including intake valves and an exhaust valve between a plurality of operating modes different in output characteristics. Whether or not the operating mode of the valve system should be switched is determined. The execution of the switching of the operating mode of the valve system based on the determination is suppressed according to a degree of suppression set depending on detected load on the engine.

9 Claims, 10 Drawing Sheets

| VALVE OPERTING MODE | 1ST INTAKE VALVE IV1 | 2ND INTAKE VALVE IV2 | EXHAUST VALVE |
|---|---|---|---|
| NORMAL MODE | NORMAL | NORMAL | NORMAL |
| RETARDED-CLOSING MODE | RETARDED-CLOSING | IDLE | NORMAL |
| IDLE MODE | IDLE | IDLE | IDLE |

FIG. 10

MVTECCNTACC

| VTECMODE REQ / VTECMODE | NORMAL | RETARDED-CLOSING | IDLE CYLINDER |
|---|---|---|---|
| NORMAL | | 50 | 50 |
| RETARDED-CLOSING | 2 | | 50 |
| IDLE CYLINDER | 2 | 2 | |

FIG. 11

MVTECCNT

| VTECMODE REQ / VTECMODE | NORMAL | RETARDED-CLOSING | IDLE CYLINDER |
|---|---|---|---|
| NORMAL | | 10 | 10 |
| RETARDED-CLOSING | 10 | | 10 |
| IDLE CYLINDER | 10 | 10 | |

VALVE CONTROL SYSTEM FOR INTERNAL COMBUSTION ENGINE

BACKGROUND OF THE INVENTION

1. Field of the Invention

The present invention relates to a valve control system for an internal combustion engine that is capable of selectively switching the operating mode of a valve system including intake valves and exhaust valves between a plurality of operating modes different in output characteristics.

2. Description of the Related Art

Conventionally, a valve control system of this kind has been proposed in the Publication of Japanese Patent No. 2619696. The internal combustion engine for which this valve control system is provided includes a variable valve timing mechanism that is capable of switching the valve timing (hereinafter referred to as "V/T") of intake valves and/or exhaust valves between low-speed V/T suitable for low engine speed operation and high-speed V/T suitable for high engine speed operation. This variable V/T mechanism is of a hydraulic type that changes the V/T between the low-speed V/T and the high-speed V/T by supply and stoppage of hydraulic pressure by opening and closing a hydraulic pressure control valve provided in an oil passage.

This valve control system selects the low-speed V/T when the engine speed is lower than a first predetermined value on a low engine speed side, and the high-speed V/T when the engine speed is higher than a second predetermined value on a high engine speed side. Further, when the engine speed is between the first predetermined value and the second predetermined value, the V/T is switched at a time point the fuel injection amount set for the low-speed V/T and that set for the high-speed V/T become equal to each other. For example, when conditions for switching the V/T to the low-speed V/T are satisfied, the hydraulic pressure control valve is closed and the supply of the hydraulic pressure is stopped, and thereafter until the detected hydraulic pressure in the oil passage lowers to a predetermined pressure level, and further a predetermined time period elapses after the lowering of the hydraulic pressure to the predetermined pressure level, the fuel injection amount is held at a value for the high-speed V/T, and upon the lapse of the predetermined time period, the fuel injection amount is switched to a value for the low-speed V/T. Similarly, in switching the V/T to the high-speed V/T, after the hydraulic pressure starts to be supplied, when the detected hydraulic pressure in the oil passage rises to a predetermined pressure level, and further a predetermined time period elapses thereafter, the fuel injection amount is switched to a value suitable for the high-speed V/T. As described above, when switching the V/T, only after the lapse of the predetermined time period, the fuel injection amount suitable for a destination V/T is applied, whereby the fuel injection amount can be appropriately set while compensating for the delay in response to the control occurring before the switching of the variable V/T mechanism is actually completed after the hydraulic pressure control valve is closed or opened.

In the conventional valve control system described above, the supply and stoppage of the hydraulic pressure for switching the V/T is instantly carried out when the conditions therefor are satisfied. Therefore, when the engine is operated in a boundary area between respective operating regions for the two types of V/T, the frequency of switching between the supply and stoppage of the hydraulic pressure is increased, so that the driver feels the switching operation so frequent (busy) so that drivability is degraded. On the other hand, the fuel injection amount is not switched to the destination V/T before the lapse of the predetermined time period after the conditions for switching the V/T are satisfied. Therefore, when operating conditions of the engine, such as load thereon, are largely changed, e.g. when the demand for acceleration is high e.g. at the standing start of the vehicle, it takes longer time before the fuel injection amount is switched to a value suitable for the destination V/T, which impairs the feeling of acceleration to cause the driver to feel the operation of the vehicle tardy. This also prevents excellent drivability from being obtained. Further, there has been recently proposed a variable valve-actuating mechanism that is capable of switching the operating mode of the valve system between three or more modes. Particularly in such a variable valve-actuating mechanism, depending on operating conditions of the engine, there is a higher possibility of the switching of the operating mode being carried out at short intervals, making conspicuous the above-described problems.

SUMMARY OF THE INVENTION

It is an object of the invention to provide a valve control system for an internal combustion engine, which enables the operating mode of a valve system to be switched in optimal timing while preventing the driver from feeling the switching operation so busy and at the same time securing feeling of acceleration, thereby improving drivability.

To attain the above object, the present invention provides a valve control system for an internal combustion engine, for controlling operation of a valve system including an intake valve and an exhaust valve, comprising:

a variable valve-actuating mechanism that is capable of selectively switching an operating mode of the valve system between a plurality of operating modes different in output characteristics;

operating mode switching-determining means for determining whether or on the operating mode of the valve system should be switched;

switching suppression means for suppressing execution of switching of the operating mode by the variable valve-actuating mechanism based on the determination by the operating mode switching-determining means;

load-detecting means for detecting load on the engine; and suppression degree-setting means for setting the degree of suppression of the switching of the operating mode by the switching suppression means depending on the detected load on the engine.

With the arrangement of the valve control system for an internal combustion engine, the operating mode of the valve system is selectively switched by the variable valve-actuating mechanism to one of a plurality of operating modes different in output characteristics. Further, when it is determined by the operating mode-switching means that the operating mode should be switched, the execution of the switching of the operating mode by the variable valve-actuating mechanism is suppressed by the switching suppression means, and the degree of the suppression is set depending on the detected load on the engine. Thus, when the operating mode of the valve system is switched, the degree of suppression of the switching is set depending on the load on the engine, which makes it possible to execute the switching of the operating mode in appropriate timing dependent on the actual load on the engine. As a result, it is possible to properly prevent the driver from feeling the switching operation so frequent or busy, and secure the feeling of acceleration, whereby drivability can be improved.

Preferably, the suppression degree-setting means sets the degree of suppression of the switching as a delay time period over which the execution of the switching by the variable valve-actuating mechanism is delayed after the operating mode switching-determining means has determined that the operating mode should be switched, the valve control system further comprising delay time-measuring means for measuring the delay time period based on time.

With the arrangement of the preferred embodiment, the degree of suppression of the switching of the operating mode of the valve system is set as a delay time period over which the execution of the switching is delayed after the determination that the operating mode should be switched, and the delay time period is measured based on time. Therefore, the switching of the operating mode can be executed in accurate timing measured based on time.

Preferably, the suppression degree-setting means sets the degree of suppression of the switching as a delay time period over which the execution of the switching by the variable valve-actuating mechanism is delayed after the operating mode switching-determining means has determined that the operating mode should be switched, the valve control system further comprising delay time-measuring means for measuring the delay time period based on a rotational speed of the engine.

The repetition period of operation of the valve system varies with the rotational speed of the engine (engine speed). Therefore, with the arrangement of this preferred embodiment, by measuring the delay time period based on the rotational speed of the engine, the switching of the operation can be executed in appropriate timing dependent on the repetition period of operation of the valve system.

Preferably, when the degree of increase in the load on the engine is larger than a predetermined value, the suppression degree-setting means sets the degree of suppression of the switching to a smaller value when the operating mode is to be switched to an operating mode having higher output characteristics than when the operating mode is to be switched to an operating mode having lower output characteristics.

With the arrangement of the preferred embodiment, when the degree of increase in the load on the engine is large, the degree of suppression of the switching is set to a smaller value when the operating mode is to be switched to an operating mode having higher output characteristics. Therefore, for example, when the degree of increase in the load is large, and therefore the demand for acceleration is large, the operating mode can be promptly switched to the operating mode having the higher output characteristics, thereby securing excellent acceleration feeling. On the other hand, when the degree of increase in the load is small, and therefore the demand for acceleration is small, the switching of the operating mode to an operating mode having lower output characteristics is suppressed, whereby the current operating mode is caused to be continued longer, thereby preventing the driver from feeling the switching operation so frequent or busy.

Preferably, the plurality of operating modes include at least three operating modes.

As described hereinbefore, as there are more types of operating mode of the valve system, there is a higher possibility of switching therebetween in shorter time periods at higher frequency, so that the switching is more likely to bring about the inconveniences. With the arrangement of the preferred embodiment, the operating modes include at least three operating modes different in output characteristics, and control is provided on the degree of suppression of the switching between any two of them, which makes it possible to more effectively obtain the advantageous effects describe above particularly when there are many operating modes.

Preferably, the engine is installed on a hybrid vehicle together with an electric motor directly connected to the engine, and the plurality of operating modes include an idle cylinder mode in which the valve system is made idle in a state of the hybrid vehicle being driven by the electric motor.

In the case of a hybrid vehicle in which the electric motor is directly connected to the engine, when the vehicle is driven by the motor, the engine directly connected to the electric motor rotates together with the electric motor, so that frictions occurring as the pistons reciprocate in the associated cylinders act as resistance to rotation of the electric motor. With the arrangement of the preferred embodiment, the plurality of operating modes of the valve system includes an idle cylinder mode in which the operation of the valve system is stopped, and in the above-mentioned type of the hybrid vehicle in which the engine and the motor are directly connected to each other, the operating mode is set to the idle cylinder mode when the vehicle is driven by the electric motor. The frictions occurring in the engine in the idle cylinder mode are smaller since the air does not flow in and out via the valves made idle, so that the loss of energy for driving the motor can be reduced to the minimum, whereby fuel economy can be improved.

The above and other objects, features, and advantages of the invention will become more apparent from the following detailed description taken in conjunction with the accompanying drawings.

BRIEF DESCRIPTION OF THE DRAWINGS

FIG. 10 is a diagram showing a MVTECCNTACC map for setting a switching delay value VTECCNTOK when acceleration is demanded;

FIG. 11 is a diagram showing a MVTECCNT map for setting a switching delay value VTECCNTOK when acceleration is not demanded;

DETAILED DESCRIPTION OF THE PREFERRED EMBODIMENTS

Figure 1:
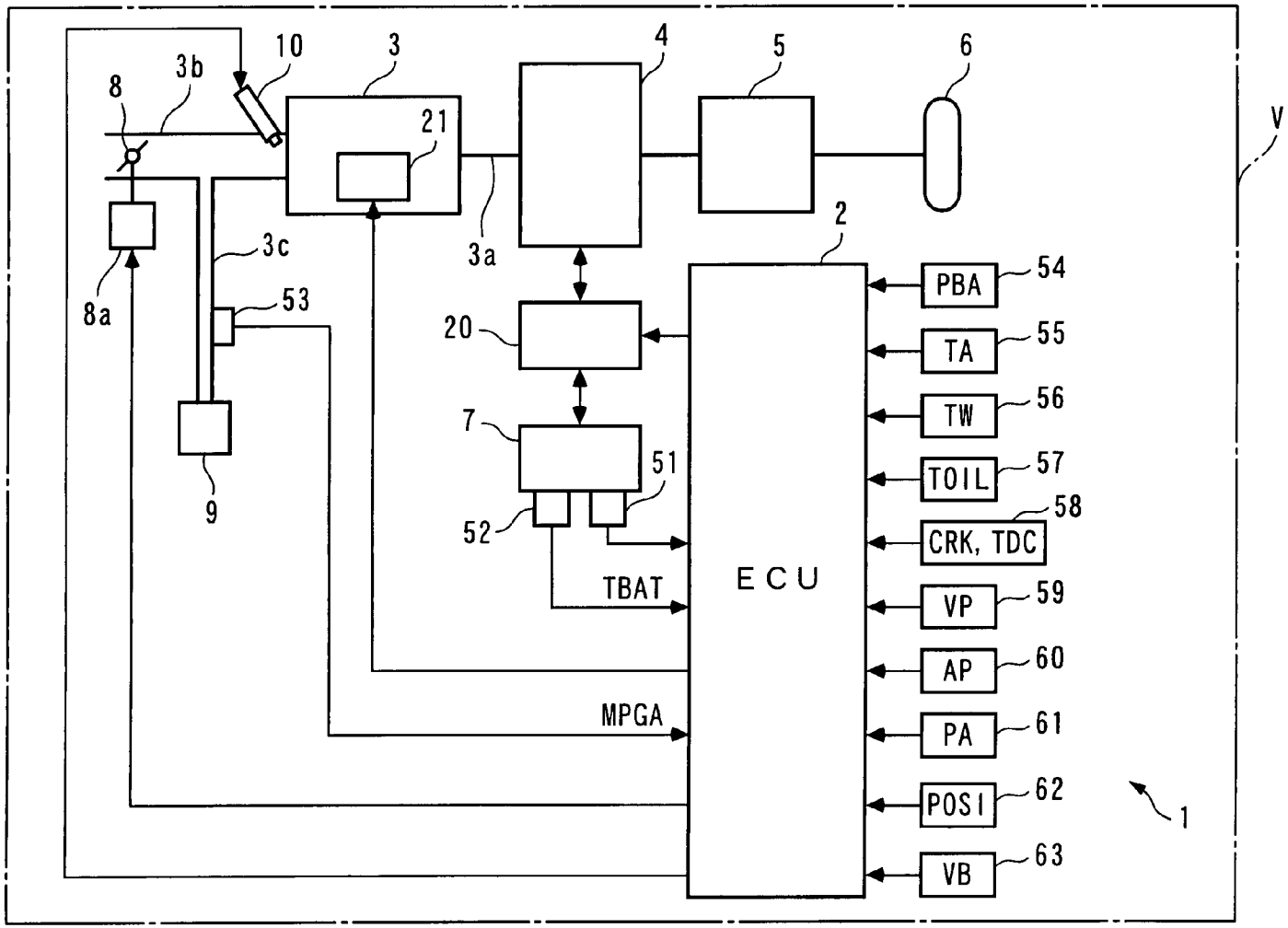
FIG. 1 is a block diagram schematically showing the arrangement of a control system according to the present invention and a vehicle to which is applied the control system.

The invention will now be described in detail with reference to the drawings showing a valve control system 1 for an internal combustion engine, according to a preferred embodiment of the present invention, and a vehicle V on the system 1 is installed.

The vehicle V is of a hybrid type that is equipped with an internal combustion engine (hereinafter referred to as "the engine") 3 and an electric motor 4, and is operated while switching a driven mode thereof between an engine-driven mode in which the vehicle V is driven by the engine 3 and a motor-driven mode in which the vehicle V is driven by the electric motor 4. The engine 3 has a crankshaft 3*a* thereof directly connected to the electric motor 4, and the crankshaft 3*a* is connected to driving wheels 6 of the vehicle 4 via an automatic transmission 5 including a torque converter (not shown), and so forth.

The electric motor 4 is connected to a battery 7 as a drive source via a power drive unit (hereinafter referred to as "the PDU") 20 which is formed by an electric circuit comprised of an inverter. Further, the electric motor 4 also servers as a generator that carried out power generation using rotating energy of the driving wheels. The electric energy generated by the electric motor 4 charges the battery 7 (regeneration) via the PDU 20. Further, the electric motor 4 is connected to an ECU 2 via the PDU 20.

The battery 7 is provided with a current-voltage sensor 51 and a battery temperature sensor 52. The current-voltage sensor 51 detects current and voltage values of electric current inputted to and outputted from the battery 7, and delivers signals indicative of the detected current and voltage values to the ECU 2. The ECU 2 calculates a remaining charge QBAT of the battery 7. The battery temperature sensor 52 detects the temperature TBAT of the battery 7, and delivers a signal indicative of the detected temperature TBAT to the ECU 2.

Figure 2:
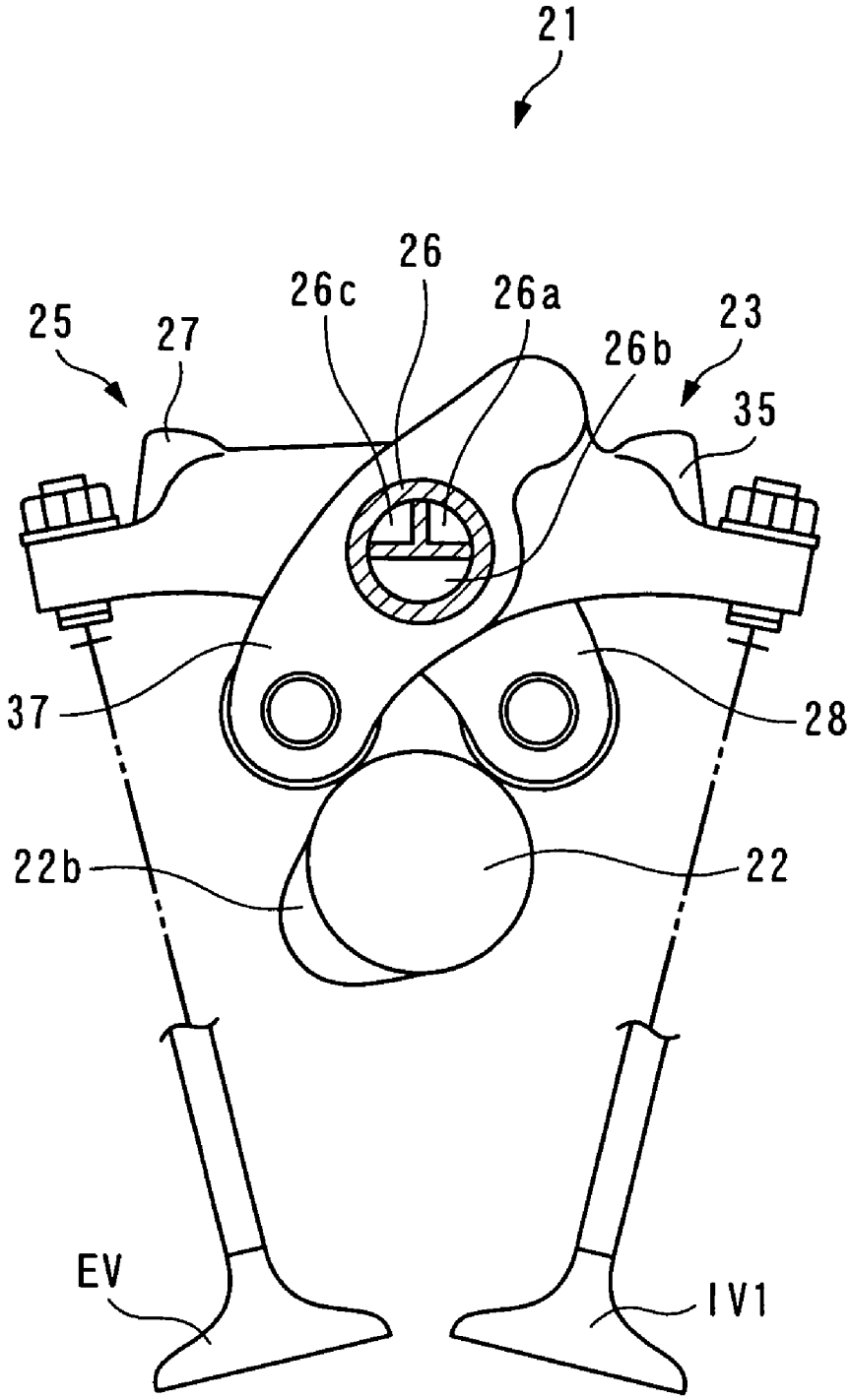
FIG. 2 is diagram schematically showing the arrangement of first and second intake valves, an exhaust valve and a variable valve-actuating mechanism.
Figure 3:
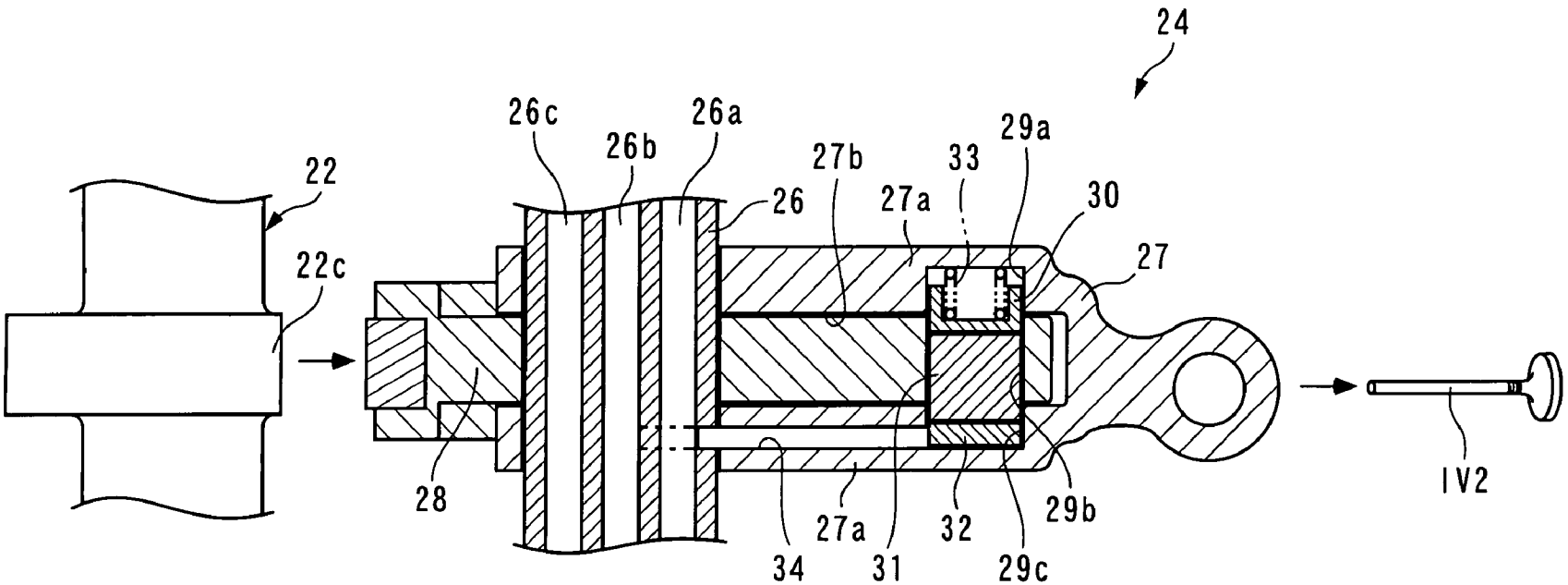
FIG. 3 is diagram schematically showing the arrangement of the second intake valve, a second intake rocker arm, and a camshaft.
Figure 4:
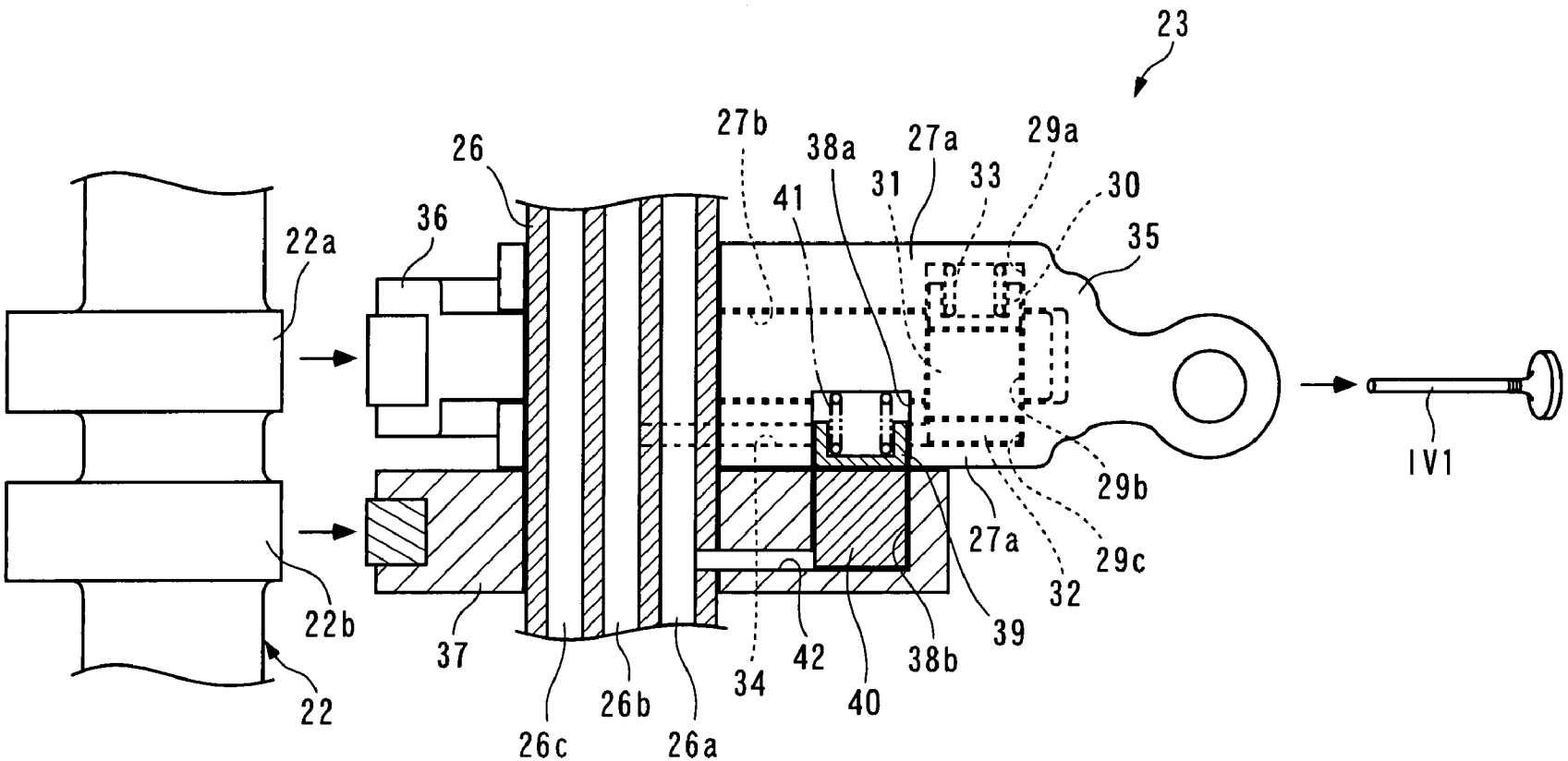
FIG. 4 is a diagram schematically showing the arrangement of the first intake valve, a first intake rocker arm, and the camshaft.

The engine 3 is e.g. a four-cycle four-cylinder SOHC gasoline engine, and includes a first intake valve IV1, a second intake valve IV2, and an exhaust valve EV (valve system), as shown in FIGS. 2 to 4, which is provided for each cylinder. The first and second intake valves IV1 and IV2 and the exhaust valve EV are actuated by a variable valve-actuating mechanism 21. These valves IV1, IV2, and EV are urged by respective springs (not shown) provided therefor, in the valve-closing direction.

The variable valve-actuating mechanism 21 includes a camshaft 22 having a plurality of cams for actuating the first and second exhaust valves IV1 and IV2 and the exhaust valve EV, and a first intake rocker arm 23 and a second intake rocker arm 24, and an exhaust rocker arm 25, for transmitting the motions of the associated cams to the first and second intake valves IV1 and IV2 and the exhaust valve EV, respectively.

Figures 5, 6:
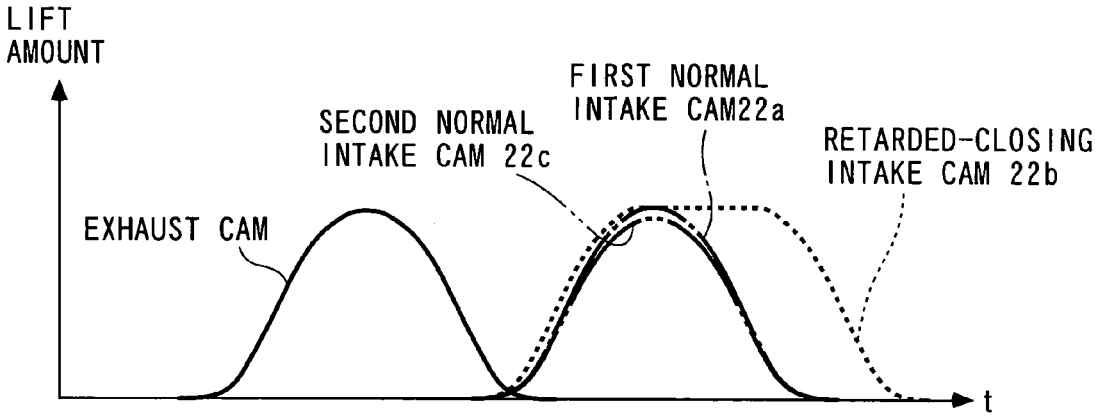
FIG. 5 is a diagram showing valve lift curves of intake and exhaust valves obtained when the valves are actuated using first and second normal intake cams, a retarded-closing intake cam, and an exhaust cam.
FIG. 6 is a diagram showing a table of valve operating modes of the variable valve-actuating mechanism and respective operating states of intake and exhaust valves in the valve operating modes.

The camshaft 22 is connected to the crankshaft 3*a*, and driven for rotation such that the camshaft 22 rotates through one turn per two turns of the crankshaft 3*a*. The camshaft 22 is integrally formed with a first normal intake cam 22*a* and a retarded-closing intake cam 22*b* for actuating the first intake valve IV1, a second normal intake cam 22*c* for actuating the second intake valve IV2, and an exhaust cam (not shown) for actuating the exhaust valve EV. As shown in FIG. 5, the first normal intake cam 22*a*, the second normal intake cam 22*c*, and the exhaust cam have cam profiles configured such that the cams are equal to each other in the difference between the respective cam phases of the valve-opening timing and the valve-closing timing of the associated valve, and similar to each other in valve lift curve. In contrast, the retarded-closing intake cam 22*b* has a cam profile configured such that the first intake valve IV1 is held at a full lift over a predetermined cam phase section, and makes the valve-closing timing of the first intake valve IV1 retarded compared with the case in which the first intake valve IV is actuated by the first normal intake cam 22*a*.

The first and second intake rocker arms 23 and 24 and the exhaust rocker arm 25 are pivotally supported on the rocker arm shaft 26. The rocker arm shaft 26 is fixed to a holder (not shown), and has first to third oil passages 26*a*, 26*b*, and 26*c* formed therethrough. These first to third oil passages 26*a* to 26*c* are connected to an oil pump 14, and hydraulic pressure control valves, not shown, are disposed in respective oil passages leading to the oil pump 14. These hydraulic pressure control valves control supply and stoppage of the hydraulic pressure from the oil pump 14 to the oil passages under the control of the ECU 2.

As shown in FIG. 3, the second intake rocker arm 24 has a second valve-abutting portion 27 and a second cam-abutting portion 28 in the form of arms which are pivotally-movable about the rocker arm shaft 26. The second valve-abutting portion 27 is configured to have an inverted U shape in cross-section having a pair of side walls 27*a* and 27*a* and a top wall (not shown), with one end thereof in abutment with the upper end of the second intake valve IV2, and the other i.e. opposite end thereof rotatably supported by the rocker arm shaft 26. The second cam-abutting portion 28 has one end thereof in abutment with the second normal intake cam 22*c*, a central portion thereof pivotally supported by the rocker arm shaft 26, and the other, i.e. opposite end-side portion thereof movable into and out of a recess 27*b* formed between the side walls 27*a* and 27*a* of the second valve-abutting portion 27.

Further, one side wall 27*a* of the second valve-abutting portion 27, the second cam-abutting portion 28, and the other side wall 27*a* of the second valve-abutting portion 27 are respectively formed with cylinders 29*a* to 29*c* in respective portions thereof closer to the second intake valve IV2 with respect to the rocker arm shaft 26. These cylinders 29*a* to 29*c* become continuous with each other when the second cam-abutting portion 28 is received into the recess 27*b* of the second valve-abutting portion 27. Further, within these cylinders 29*a* to 29*c*, connection pins 30 to 32 are slidably disposed, respectively, and within the cylinder 29*a* is disposed a return spring 33 for urging the connection pins 30 to 32 toward the cylinder 29*c* on the opposite side. Further, the other side wall 27*a* of the second valve-abutting portion 27 is formed with an oil passage 34 that communicates between the second oil passage 26*b* of the rocker arm shaft 26 and the cylinder 29*c*.

With the above configuration, when the hydraulic pressure is not supplied from the oil pump 14 to the cylinder 29*c* via the second oil passage 26*b*, the urging force of the return spring 33 causes the connection pins 30 to 32 to be positioned closer to the cylinder 29*c*, with the connection pin 30 being engaged with both the one wall 27*a* of the second valve-abutting portion 27 and the second cam-abutting portion 28 in a straddling manner and the connection pin 31 being engaged with both the second cam-abutting portion 28 and the other side wall 27*a* of the second valve-abutting portion 27 in a straddling manner (state shown in FIG. 3). This connects the second valve-abutting portion 27 and the second cam-abutting portion 28 to each other, whereby the movement of the second normal intake cam 22*c* is transmitted from the second cam-abutting portion 28 to the second intake valve IV2 via the second valve-abutting portion 27. On the other hand, when the cylinder 29 is supplied with the hydraulic pressure, the connection pins 30 to 32 are moved toward the cylinder 29*a* against the urging force of the return spring 33 whereby they are received into the respective cylinders 29*a* to 29*c*. This disconnects between the second valve-abutting portion 27 and the second cam-abutting portion 28 to make these portions 27 and 28 free from each other, which causes only the second cam-abutting portion 28 to be actuated by the second normal intake cam 22*c* without transmitting the movement of the second normal intake cam 22*c* from the second cam-abutting portion 28 to the second valve-abutting portion 27.

It should be noted that the exhaust rocker arm 25 has almost the same construction as the second intake rocker arm 24, and is only distinguished from the same in that an oil passage for supplying hydraulic pressure to a cylinder thereof (neither of which is shown) communicates with the third oil passage 26*c*. Therefore, detailed description thereof is omitted.

As shown in FIG. 4, the first intake cam rocker arm 23 is comprised of a first valve-abutting portion 35 in abutment with the first intake valve IV1, a first cam-abutting portion 36 in abutment with the first normal intake cam 22*a*, and a retarded-closing cam-abutting portion 37 in abutment with the retarded-closing intake cam 22*b*. The first valve-abutting portion 35 and the first cam-abutting portion 36 are constructed similarly to the second valve-abutting portion 27 and the second cam-abutting portion 28, described hereinabove, and therefore detailed description thereof is omitted while designating components and portions thereof using the same reference numerals. In FIG. 4, for clarity purposes, hatching of the first valve-abutting portion 35 and the first cam-abutting portion is omitted.

The retarded-closing cam-abutting portion 37 has a central portion thereof pivotally supported by the rocker arm shaft 26, and an end thereof opposite from the first intake valve IV1 in abutment with the retarded-closing intake cam 22*b*. Further, the first valve-abutting portion 35 and the retarded-closing cam-abutting portion 37 are formed with cylinders 38*a* and 38*b* which can be made continuous with each other, in respective portions thereof closer to the first intake valve IV1 with respect to the rocker arm shaft 26. Within these cylinders 38*a* and 38*b*, connection pins 39 and 40 are slidably disposed, respectively, and within the cylinder 38*a* is disposed a return spring 41 for urging the connection pins 39 and 40 toward the retarded-closing cam-abutting portion 37. Further, the retarded-closing cam-abutting portion 37 is formed with an oil passage 42 communicating between the first oil passage 26*a* of the rocker arm shaft 26 and the cylinder 38*b*.

With the above configuration, when the hydraulic pressure is not supplied from the oil pump 14 to the cylinder 38*b* via the first oil passage 26*a*, the urging force of the return spring 41 causes the connection pins 39 and 40 to be received within the cylinders 38*a* and 38*b* (state shown in FIG. 4), respectively. This disconnects between the first valve-abutting portion 35 and the retarded-closing cam-abutting portion 37 to make these portions 35 and 37 free from each other, which causes only the retarded-closing cam-abutting portion 37 to be actuated by the retarded-closing intake cam 22*b* without transmitting the movement of the retarded-closing intake cam 22*b* from the retarded-closing cam-abutting portion 37 to the first valve-abutting portion 35. On the other hand, when the cylinder 38*b* is supplied with the hydraulic pressure, the connection pins 39 and 40 are moved toward the first valve-abutting portion 35 against the urging force of the return valve 41, whereby the connection pin 40 engages with both the first valve-abutting portion 35 and the retarded-closing cam-abutting portion 37 in a straddling manner, which connects between the first valve-abutting portion 35 and the retarded-closing cam-abutting portion 37.

In the variable valve-actuating mechanism 21 constructed as described above, as shown in FIG. 6, the first and second intake valves IV1 and IV2 and the exhaust valve EV are actuated in the following three valve operating modes:

1. Normal Mode

The supply of the hydraulic pressure to the rocker arms is inhibited.

The first intake valve IV1 is actuated by the first normal cam 22*a*, the second intake valve IV2 by the second normal intake cam 22*c*, and the exhaust valve EV by the exhaust cam.

2. Retarded-closing Mode

The first and second intake rocker arms 23 and 24 are supplied with the hydraulic pressure, and at the same time the supply of the hydraulic pressure to the exhaust rocker arm 25 is inhibited.

The first intake valve IV1 is actuated by the retarded-closing intake cam 22*b*, with the second intake valve IV2 made idle, and the exhaust valve EV by the exhaust cam. This makes the valve-closing timing of the first intake valve IV1 retarded compared with that in the normal mode, i.e. sets the same to a predetermined crank angle (e.g. 80° C.) after the bottom dead center (BDC) position at the start of the compression stroke.

In this retarded-closing mode, compared with the normal mode, the compression ratio becomes small, so that the output characteristics of the engine 3 are lowered. Further, during the retarded-closing mode, the opening of a throttle valve 8, referred to hereinafter, is caused to be made wider, whereby the pumping loss caused by the throttling of the throttle valve 8 is reduced. This makes it possible to obtain more excellent fuel economy mainly in the low-load, low-engine speed region, than in the normal mode.

3. Idle Cylinder Mode.

The second intake rocker arm 24 and the exhaust rocker arm 25 are supplied with the hydraulic pressure, and at the same time the first intake rocker arm 23 has only the first valve-abutting portion 35 thereof supplied with the hydraulic pressure.

All the valves are made idle, i.e. held in closed position.

This idle cylinder mode is employed in the motor-driven mode of the vehicle V, with the supply of fuel to the engine 3 being stopped to stop the operation thereof. The vehicle V of the present embodiment is a hybrid vehicle of a type in which the engine 3 and the electric motor 4 are directly connected to each other. Therefore, in the motor-driven mode, frictions occurring as the pistons reciprocate in the associated cylinders (not shown) act as resistance to rotation of the electric motor 4. In contrast, in the idle cylinder mode, the frictions occurring in the engine in the idle cylinder mode are smaller since the air does not flow in and out via the valves made idle. Therefore, by setting the valve operating mode to the idle cylinder mode when the vehicle V is in the motor-driven mode, the loss of energy for driving the motor 4 can be reduced to the minimum, whereby fuel economy can be improved.

Further, an intake pipe 3*b* of the engine 3 has the throttle valve 8 arranged therein, which is connected to a rotational shaft of a motor 8*a* implemented by a DC motor. Through the control of the duty ratio of drive current supplied to the motor 8*a*, the opening of the throttle valve 8 is controlled.

The intake valve 3*b* has a brake booster 9 connected thereto at a location downstream of the throttle valve 8 via a branch pipe 3*c*. The brake booster 9 is comprised of a circular diaphragm made of rubber. Further, the brake booster 9 is supplied with negative pressure generated by closing of the throttle valve 8, and the supplied negative pressure within the brake booster 9 amplifies the stepping-on force of the driver applied to a brake pedal (not shown). The branch pipe 3*c* has a negative pressure sensor 53 inserted therein which detects the negative pressure MPGA within the brake booster 9, and delivers a signal indicative of the detected negative pressure MPGA to the ECU 2.

Also, the intake manifold of the intake valve 3*b* has injectors 10 (only one of which is shown) mounted therein such that each injection 10 faces the combustion chamber (not shown) of each cylinder. A time period over which the injector 10 is caused to open provides the fuel injection period, and is controlled by the ECU 2. Further, an intake pipe absolute pressure sensor 54 and an intake air temperature sensor 55 are mounted in the intake valve at respective locations downstream of the throttle valve 8. The intake pipe absolute pressure sensor 54 and the intake air temperature sensor 55 detect intake pipe absolute pressure PBA within the intake pipe 3*b* and intake air temperature TA, respectively, and delivers respective signals indicative of the detected intake pipe absolute pressure PBA and intake air temperature TA to the ECU 2.

Further, the cylinder block (not shown) of the engine 3 has an engine coolant temperature sensor 56, an engine oil temperature sensor 57, and a crank angle sensor 58 mounted therein. The engine coolant temperature sensor 56 detects engine coolant temperature TW as the temperature of coolant circulating through the cylinder block, and deliver a signal indicative of the detected engine coolant temperature TW to the ECU 2. The engine oil temperature sensor 57 detects engine oil temperature TOIL as the temperature of engine oil, and delivers a signal indicative of the detected engine oil temperature TOIL to the ECU 2. The crank angle sensor 58 supplies a CRK signal and a TDC signal as pulse signals to the ECU 2. Each pulse of the CRK signal is delivered whenever the crankshaft 3*a* of the engine 3 rotates through a predetermined crank angle, and the ECU 2 determines the rotational speed of the crankshaft 3*a* (hereinafter referred to as "the crankshaft rotational speed") NE based on the CRK signal. The TDC signal is indicative of the piston (not shown) of each cylinder being at a predetermined crank angle position in the vicinity of the top dead center (TDC) at the start of the suction stroke of the piston, and in the case of the four-cylinder engine of the illustrated example, it is delivered whenever the crankshaft 3*a* rotates through 180 degrees.

Further, the vehicle V is provided with an auxiliary battery (not shown) for supplying electrical energy to hydraulic pressure control valves of the above-described variable valve-actuating mechanism 21. The auxiliary battery has a voltage sensor 63 mounted thereon, and detects the voltage VB of the auxiliary battery to deliver a signal indicative of the detected auxiliary battery voltage VB to the ECU 2.

Further, the ECU 2 is supplied with a signal indicative of a traveling speed (hereinafter referred to as "the vehicle speed") VP of the vehicle V from a vehicle speed sensor 59, a signal indicative of an stepped-on amount (hereinafter referred to as "the accelerator pedal opening") AP of an accelerator pedal (not shown) from an accelerator pedal opening sensor 60, a signal indicative of the atmospheric pressure from an atmospheric pressure sensor 61, and a signal indicative of the position POSI of a shift lever (not shown) from a shift position sensor 62.

The ECU 2 forms operating mode-switching determining means, switching suppression means, load-detecting means, suppression degree-setting means, delay time-counting means, and delay time-measuring means, and is formed by a microcomputer including an I/O interface, a CPU, a RAM, and a ROM. The signals of the aforementioned various sensors 51 to 63 are each input to the CPU after A/D conversion and waveform shaping by the I/O interface.

The CPU determines operating conditions of the engine 3 and the vehicle V based on these input signals, and sets the driven mode of the vehicle V to the engine-driven mode or the motor-driven mode depending on the determined operating conditions of the vehicle V according to a control program read from the ROM and so forth, and at the same time, the valve operating mode to the normal mode, the retarded-closing mode, or the idle cylinder mode. Further, according to the result of these settings, the CPU controls operations of the engine 3, such as fuel injection, and driving and regenerating operation of the electric motor 4.

Figure 7:
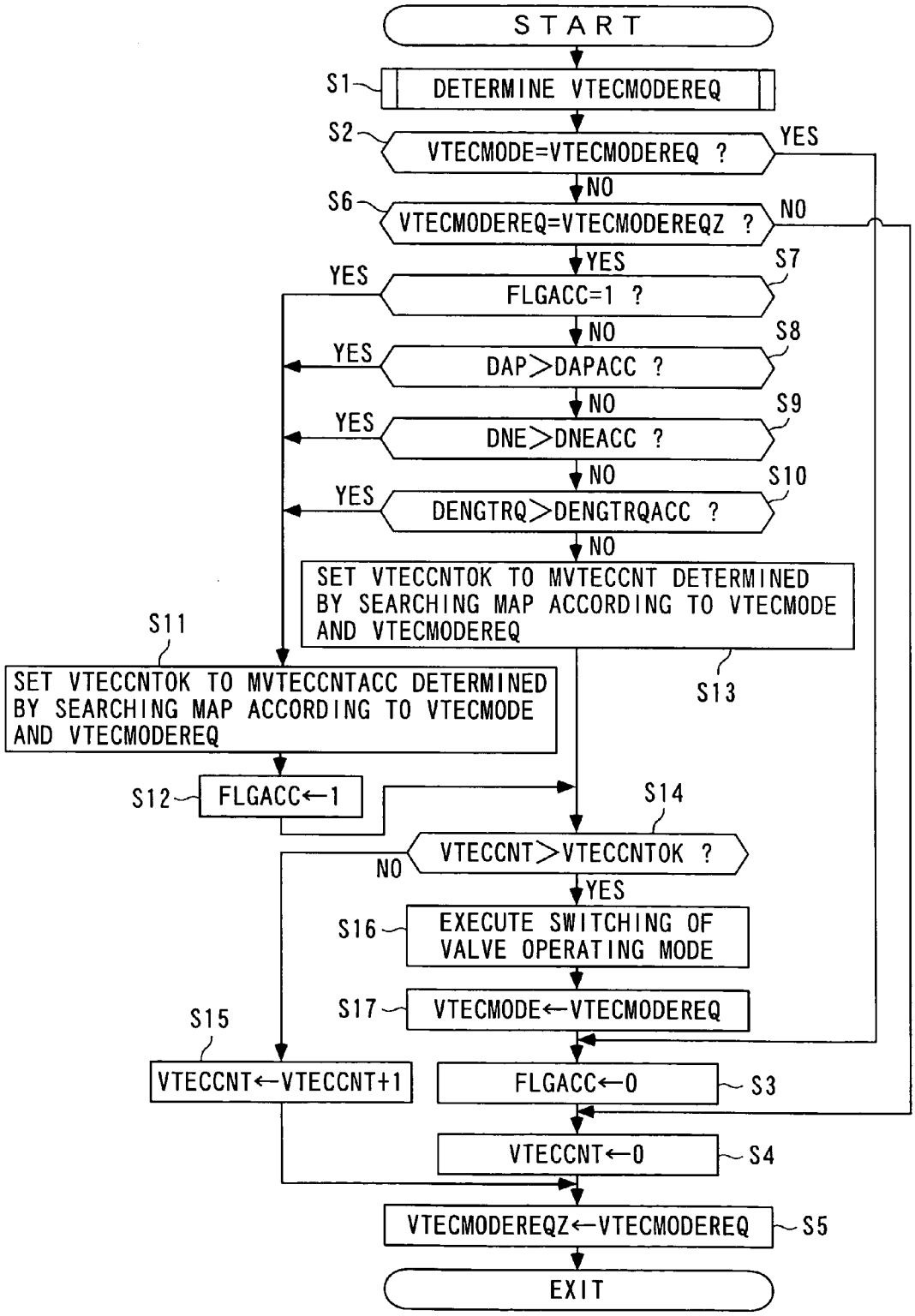
FIG. 7 is a flowchart showing a control process for controlling the switching of valve operating modes of the variable valve-actuating mechanism.
Figure 8:
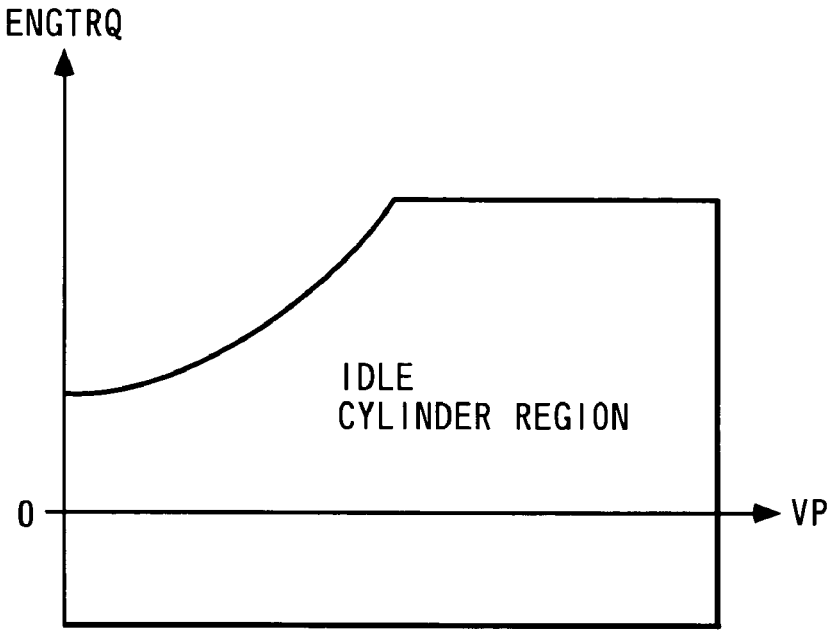
FIG. 8 is a diagram showing an example of an idle cylinder region map.

FIG. 7 shows a control process for controlling the switching of the valve operating mode by the variable valve-actuating mechanism 21, which is executed at intervals of a predetermined time period (e.g. 100 msec.). First, in a step 1 (shown as S1 in abbreviated form in FIG. 7; the following steps are also shown in abbreviated form), a demanded valve operating mode VTECMODEREQ demanded of the variable valve-actuating mechanism 21 is determined. This determination is carried out using an idle cylinder region map shown in FIG. 8 and a retarded-closing region map shown in FIG. 9. The idle cylinder region map defines an operating region (idle cylinder region) within which the valve operating mode can be set to the idle cylinder mode, using the vehicle speed VP and demanded torque ENGREQ as parameters. The demanded torque ENGREQ is expressed in values of torque demanded of the drive system including the engine 3 and the electric motor 4, and calculated by searching a demanded torque-setting map (not shown) according to the vehicle speed VP and the accelerator pedal opening AP.

The idle cylinder region is basically defined as a region in which the amount of energy to be consumed when the vehicle travels in the idle cylinder mode in the motor-driven mode of the vehicle is less than the amount of energy (including fuel and electricity) to be consumed when the vehicle travels in the normal mode or the retarded-closing mode. Even when the vehicle V is within the idle cylinder region, if the crankshaft rotational speed NE, the remaining charge QBAT of the battery 8, the intake air temperature TA, the engine coolant temperature TW, the engine oil temperature TOIL, the atmospheric pressure PA, the auxiliary battery voltage VB, the position POSI of the shift lever, the temperature TBAT of the battery 7, the negative pressure MPGA within the brake booster 9, and so forth, do not satisfy predetermined conditions, it is determined that the idle cylinder mode should not be selected but the normal mode or the retarded-closing mode in the engine-driven mode should be selected.

Figure 9:
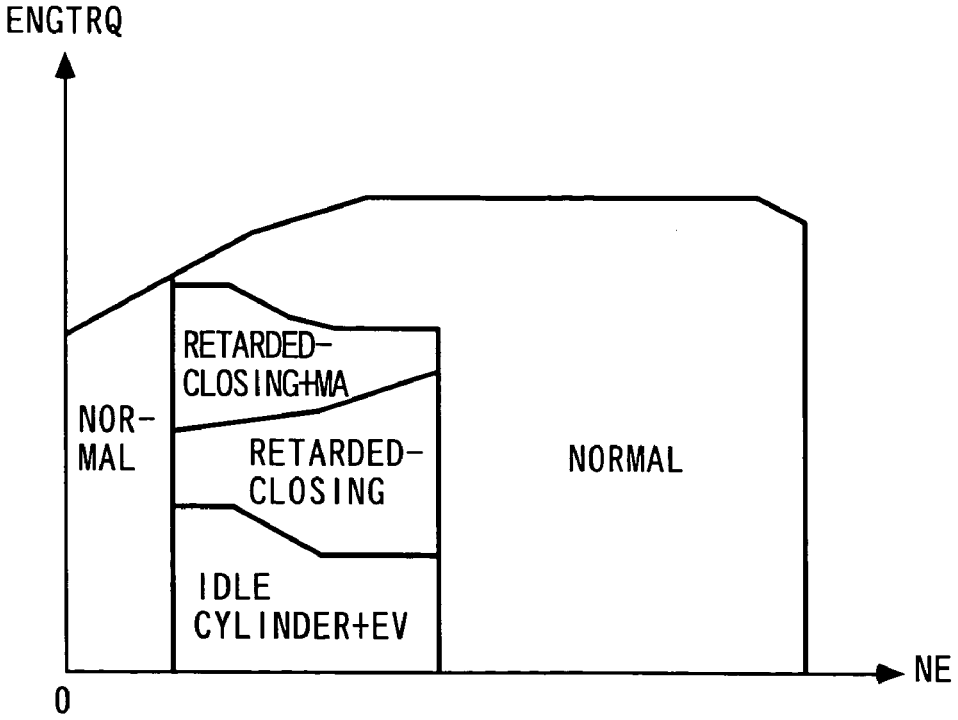
FIG. 9 is a diagram showing an example of a retarded-closing region map.

On the other hand, the retarded-closing region map shown in FIG. 9 defines, by comparison between the fuel consumption amount in the normal mode and that in the retarded-closing mode using the crankshaft rotational speed NE and the demanded torque ENGREQ as parameters, an operating region in which the latter is smaller than the former, as a retarded-closing region, and an operating region in which the former is smaller than the latter, as a normal region. It should be noted that for the same operating conditions, if the idle cylinder mode is selected by the idle cylinder map and the retarded-closing mode is selected by the retarded-closing region map, the idle cylinder mode is preferentially selected. As a result, as shown in the retarded-closing region map, the demanded valve operating mode VTECMODEREQ is set to the idle cylinder mode (+motor-driven mode (EV)), in a medium-rotational speed, low-load region, and to the retarded-closing mode, in a medium-rotational speed, medium-load region. Further, on a higher-load side than the retarded-closing region, a region (retarded-closing+MA) is defined in which the assistance using the motor 4 is carried out for assisting acceleration in the retarded-closing mode, and in regions other than the above-mentioned regions, it is determined that the valve operating mode should be set to the normal mode, i.e. the demanded valve operating mode VTECMODEREQ is set to the normal mode.

It should be noted that even within the retarded-closing region, if the vehicle speed VP, the accelerator pedal opening AP, the remaining charge QBAT of the battery 8, the engine coolant temperature TW, and so forth do not satisfy predetermined operating conditions, the demanded valve operating mode VTECMODEREQ is not set to the retarded-closing mode but to the normal mode.

Referring again to FIG. 7, in a step 2 following the step 1, it is determined whether or not the demanded valve operating mode VTECMODEREQ determined in the step 1 agrees with the actual valve operating mode VTECMODE of the engine 3 actually set by the variable valve-actuating mechanism 21. If the answer to this question is affirmative (YES), i.e. if the two modes agree with each other, it is judged that the switching of the valve operating mode is not demanded, so that an acceleration-time switching delay flag FLGACC and a counter value VTECCNT of a switching delay counter are set to 0 in respective steps 3 and 4. Next, the demanded valve operating mode VTECMODEREQ is shifted to the immediately preceding value VTECMODEREQZ in a step 5, followed by terminating the present process.

If the answer to the question of the step 2 is negative (NO), i.e. if the demanded valve operating mode VTECMODEREQ is different from the actual valve operating mode VTECMODE, it is judged that the switching of the valve operating mode is demanded, so that the process proceeds to a step 6, wherein it is determined whether or not the demanded valve operating mode VTECMODEREQ agrees with the immediately preceding value VTECMODEREQZ. Immediately after occurrence of the demand for switching the valve operating mode, the answer to this question is negative (NO), so that in this case, the process proceeds to the steps 4 et seq. to reset the counter value VTECCNT of the delay counter to 0.

On the other hand, if the answer to the question of the step 6 is affirmative (YES), i.e. if the demanded valve operating mode VTECMODEREQ agrees with the immediately preceding demanded valve operating mode VTECMODEREQZ, it is determined in a step 7 whether or not the acceleration-time switching delay flag FLGACC is equal to 1. The execution of the step 3 makes the answer to this question negative (NO) immediately after the occurrence of the demand for switching the valve operating mode, so that in this case, in the following steps 8 to 10, it is determined whether or not the demand for acceleration of the drive system is large.

More specifically, it is determined in a step 8 whether or not the accelerator pedal opening change DAP as the difference between the current value and the immediately preceding value of the accelerator pedal opening AP is larger than a predetermined acceleration reference value DAPACC (e.g. 1 degree), in a step 9 whether or not the rotational speed change DNE as the difference between the current value and the immediately preceding value of the crankshaft rotational speed NE is larger than an predetermined reference value DNEACC (e.g. 200 rpm), and in a step 10 whether or not the demanded torque change DENGTRQ as the difference between the current value and the immediately preceding value of the demanded torque ENGREQ is larger than a predetermined acceleration reference value DENGTRQACC (e.g. 3 Nm). If any of the answers to these questions is affirmative (YES), the degree of increase in the load is large and hence the demand for acceleration is large, so that the process proceeds to a step 11, wherein a map shown in FIG. 10 is searched according to the actual valve operating mode VTECMODE and the demanded valve operating mode VTECMODEREQ to determine an acceleration-time map value MVTECCNTACC and set the same to a switching delay value VTECCNTOK (delay time period). Then, to indicate that it is during the switching delay at the time of acceleration being demanded, the acceleration-time switching delay flag FLGACC is set to "1" (step 12), and the process proceeds to a step 14, referred to hereinafter.

As shown in FIG. 10, the acceleration-time map value MVTECCNTACC is set to a relatively large value of 50 (equivalent to 5.0 seconds) for switching to the lower output (power) side, when the valve operating mode is to be switched from the normal mode to the retarded-closing mode, from the normal mode to the idle cylinder mode, or from the retarded closing mode to the idle cylinder mode, i.e. to be switched to a valve operating mode lower in the output characteristics. On the other hand, the acceleration-time map value MVTECCNTACC is set to a relatively small value of 2 (equivalent to 0.2 seconds) for switching to the higher output (power) side, when the valve operating mode is switched in an opposite direction, i.e. from the retarded-closing mode to the normal mode, from the idle cylinder mode to the normal mode, or from the idle cylinder mode to the retarded-closing mode, i.e. switched to a valve operating mode higher in the output characteristics.

On the other hand, if all the answers to these questions are negative (NO), it is judged that the degree of increase in the load is small and hence the demand for acceleration is not large, so that the process proceeds to a step 13, wherein a map shown in FIG. 11 is searched according to the actual valve operating mode VTECMODE and the demanded valve operating mode VTECMODEREQ to determine a non-acceleration-time map value MVTECCNT, and set the same to the switching delay value VTECCNTOK. As shown in FIG. 11, the non-acceleration-time map value MVTECCNT is set to a fixed value 10 (equivalent to 1.0 second) as an intermediate value between the respective values of the acceleration-time map value MVTECCNTACC in FIG. 10 for switching to the lower and higher output sides, irrespective of the direction of switching of the valve operating mode.

In a step 14 following the step 12 or 13, the counter value VTECCNT of the switching delay counter is larger than the switching delay value VTECCNTOK set in the step 11 or 13. If the answer to this question is negative (NO), i.e. if VTECCNT≦VTECCNTOK holds, i.e. if a time period (hereinafter referred to as "the switching delay period") equivalent to the switching delay value VTECCNTOK has not elapsed after the switching of the valve operating mode has been demanded, the counter value VTECCNT of the switching delay counter is incremented (step 15), and then the step 5 is carried out, followed by terminating the present process.

On the other hand, if the answer to the question of the step 14 is affirmative (YES), i.e. if VTECCNT>VTECCNTOK holds, which means that the switching delay period has elapsed after the switching of the valve operating mode was demanded, according to the demanded valve operating mode VTECMODEREQ, a drive signal is delivered to the variable valve-actuating mechanism 21, to thereby carry out the switching of the valve operating mode (step 16). Then, according to the execution of the switching, the demanded valve operating mode VTECMODEREQ is set to the actual valve operating mode VTECMODE (step 17), and then the steps 3 to 5 are carried out, followed by terminating the present process.

It should be noted that during the switching delay period before switching the valve operating mode, if the operating conditions of the vehicle are changed to cause the demanded valve operating mode VTECMODEREQ and the actual valve operating mode VTECMODE to agree with each other, the answer to the question of the step 2 becomes affirmative (YES), so that the steps 3 to 5 are carried out to reset the acceleration-time switching delay flag FLGACC and the counter value VTECCNT of the switching delay counter to 0. That is, in this case, it is judged that the switching of the valve operating mode has ceased to be demanded, so that determination as to the demand for switching is resumed thereafter. Further, during the switching delay period for switching the valve operating mode, if the demanded valve operating mode VTECMODEREQ has further changed to another mode, the answer to the question of the step 6 becomes negative (NO), so that the steps 4 and 5 are executed to reset the counter value VTECCNT of the switching delay counter to 0. That is, in this case, based on the updated demanded valve operating mode VTECMODEREQ after the change, the control of the switching delay is newly carried out.

Figure 12:
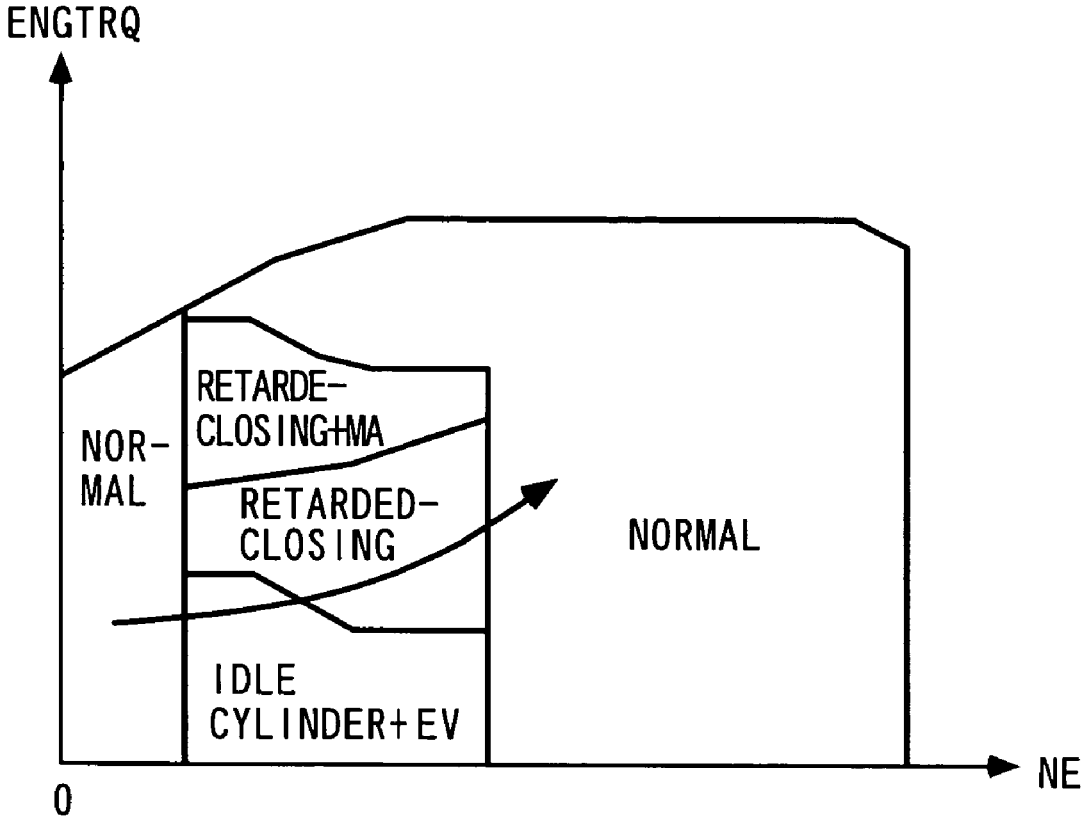
FIG. 12 is a diagram showing an example of switching of a demanded valve operating mode depicted over the retarded-closing region map.
Figure 13:
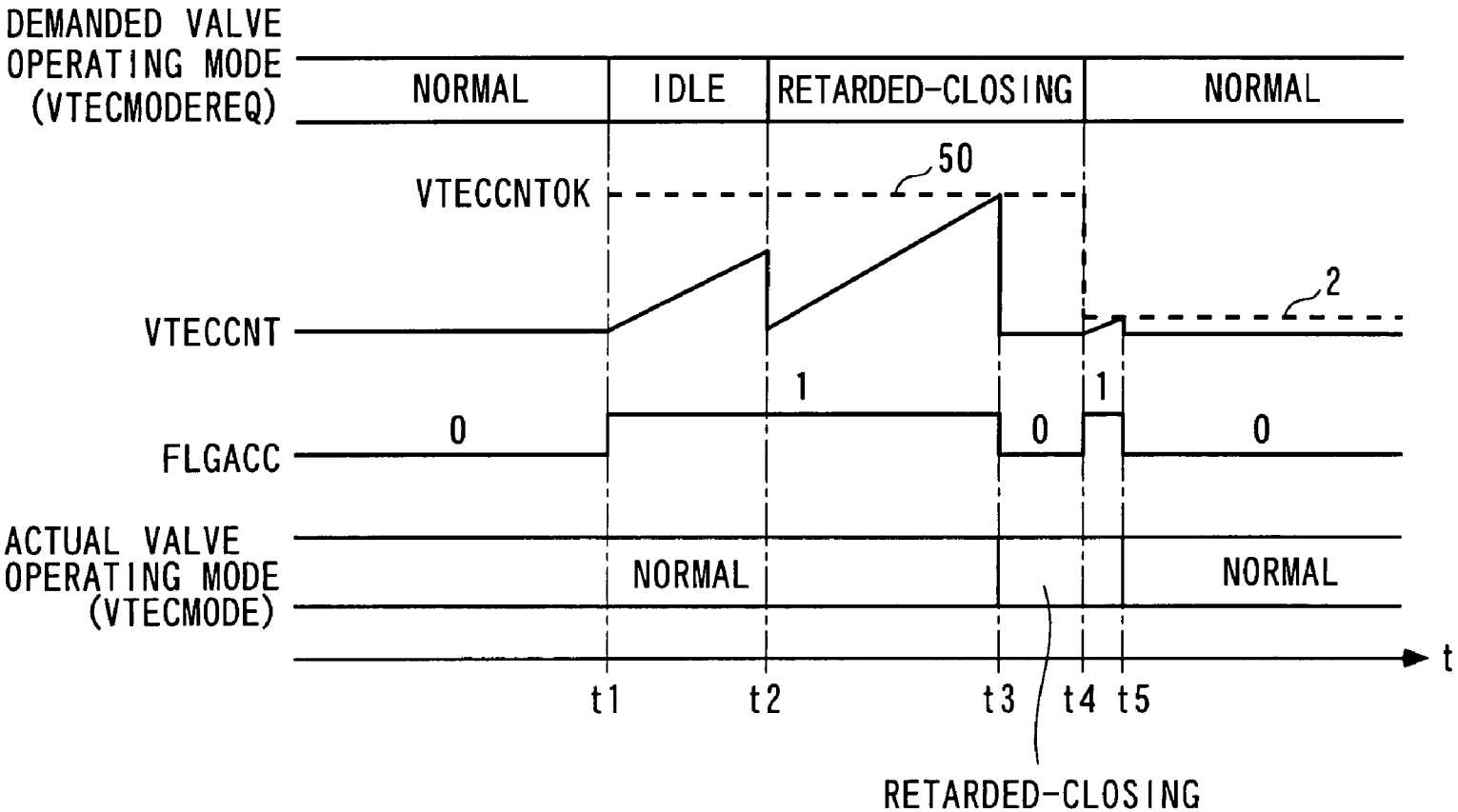
FIG. 13 is a timing chart of operations performed when the control process shown in FIG. 7 is executed according to the example of switching of the demanded valve operating mode shown in FIG. 12.

Next, an example of operations carried out according to the above-described control process will be described with reference to FIGS. 12 and 13. In the illustrated example, as indicated by an arrow in FIG. 12, it is assumed that in a state where the demand for acceleration is large, due to acceleration at the standing start of the vehicle V, the demanded valve operating mode VTECMODEREQ is switched in the sequence of the normal mode→the idle cylinder mode→the retarded-closing mode→the normal mode. First, when the demanded valve operating mode VTECMODEREQ is switched from the normal mode to the idle cylinder mode (t1 in FIG. 13), the answer to the question of the step 2 becomes negative (NO), i.e. it is determined that the demand for the switching has occurred, and at least one of the steps 8 to 10 becomes affirmative (YES), so that the steps 11 and 12 are carried out. As a result, the acceleration-time map value MVTECCNTACC is determined by searching the map shown in FIG. 10 and set to the switching delay value VTECCNTOK, and at the same time, the acceleration-time delay flag FLGACC is set to 1. In this case, the valve operating mode is switched from the normal mode to the idle cylinder mode, the value of 50 for switching to the lower output side is read out to set the switching delay value VTECCNTOK to this large value, i.e. such that the degree of suppression of the switching is large. As a result, the valve operating mode remains held at the normal mode, after the switching has been demanded, until the relatively long switching delay time period elapses to make the counter value VTECCNT of the switching delay counter larger than the switching delay value VTECCNTOK.

Thereafter, if the valve operating mode VTECMODEREQ is switched from the idle cylinder mode to the retarded-closing mode (t2 in FIG. 13) before the condition of VTECCNT>VTECCNTOK is satisfied, the answer to the question of the step 6 becomes negative (NO), which resets the counter value VTECCNT to 0 (step 4). In this case, the acceleration-time delay flag FLGACC held at 1, so that in the next loop, the answers to the respective questions of the steps 6 and 7 are both affirmative (YES), so that by executing the step 11, the acceleration-time map value MVTECCNTACC is newly determined by searching the map in FIG. 10, and set to the switching delay value VTECCNTOK. In this case, the valve operating mode is switched from the normal mode to the retarded-closing mode, the value 50 for switching to the lower output side is read out as the acceleration-time map value MVTECCNTACC, and set to the switching delay value VTECCNTOK to make it large, i.e. such that the degree of suppression of the switching is increased.

Thereafter, when the condition of VTECCNT>VTECCNTOK is satisfied, which means that the switching delay period has elapsed (time t3 in FIG. 13), the answer to the question of the step 14 is affirmative (YES), and the steps 15 and 16 are executed whereby the switching of the valve operating mode from the normal mode to the retarded-closing mode is carried out by the variable valve-actuating mechanism 21, and at the same time, the actual valve operating mode VTECMODE is set to the retarded-closing mode. Further, the acceleration-time delay flag FLGACC and the switching delay value VTECCNTOK is reset to 0 (steps 3 and 4).

Then, when the demanded valve operating mode VTECMODEREQ is switched from the retarded-closing mode to the normal mode (t4 in FIG. 13), the steps 11 and 12 are executed whereby the acceleration-time map value MVTECCNTACC is determined by searching the map in FIG. 10, and set to the switching delay value VTECCNTOK, and the acceleration-time switching delay flag FLGACC is set to 1. In this case, since the valve operating mode is switched from the retarded-closing mode to the normal mode, the value 2 for switching to the higher output side is read out as the acceleration-time map value MVTECCNTACC, and is set to the switching delay value VTECCNTOK to make it small, i.e. such that the degree of suppression of the switching is decreased.

Accordingly, in a short time period after the switching is demanded, the condition of VTECCNT>VTECCNTOK is fulfilled, and when the switching delay period has elapsed (t5 in FIG. 13), the answer to the question of the step 14 becomes affirmative (YES), so that the steps 15 and 16 are executed whereby the switching of the valve operating mode from the retarded-closing mode to the normal mode is executed by the variable valve-actuating mechanism 21, and at the same time the actual valve operating mode VTECMODE is set to the normal mode (steps 14 and 15).

As a result, in the illustrated example of operations, while the demanded valve operating mode VTECMODEREQ is switched in the sequence of the normal mode→the idle cylinder mode→the retarded-closing mode→the normal mode, the actual valve operating mode VTECMODE is not switched to the idle cylinder mode but switched in the sequence of the normal mode→the retarded-closing mode→the normal mode. Although in this example, a time period over which the retarded-closing mode is demanded becomes longer than the switching delay period, if the time period during which the demand occurs is shorter than the switching delay period, the switching to the retarded-closing mode is not executed either, which causes the valve operating mode to be held over the entire time period referred to above.

As described above, according to the present embodiment, when the degree of increase in the load is large, i.e. when the demand for acceleration is large, if the switching of the valve operating mode to a valve operating mode lower in the output characteristics is demanded, the switching delay value VTECCNTOK is set to a larger value whereby the degree of suppression of the switching is increased, so that the switching of the valve operating mode in this direction can be suppressed, whereby it is possible to prevent the driver from feeling the switching operation so frequent or busy in cases where the demanded valve operating mode VTECMODEREQ is switched at short intervals. On the other hand, when the switching of the valve operating mode to a valve operating mode higher in the output characteristics is demanded, the switching delay value VTECCNTOK is set to a smaller value, whereby the degree of suppression of the switching is decreased, to enable the valve operating mode to be switched to the valve operating mode higher in the output characteristics promptly, thereby securing the feeling of acceleration.

Further, if the degree of increase in the load is small, i.e. the demand for acceleration is small, the non-acceleration-time map value MVTECCNT is read out from the map in FIG. 11, to set the switching delay value VTECCNTOK to the intermediate value 10, irrespective of the direction of switching of the valve operating mode, whereby the degree of suppression of the switching is set to a medium. This makes it possible to prevent the driver from feeling the switching operation so frequent or busy. As a result, while preventing the switching operation from being felt as frequent or busy, and at the same time securing the feeling of acceleration, the valve operating mode can be switched in optimal timing dependent on the demanded load, and therefore drivability can be improved.

Further, since the control process in FIG. 7 is executed every predetermined time period (e.g. 100 milliseconds), the counting of the switching delay counter VTECCNT (measurement of the switching delay period) is carried out based on time, which makes it possible to carry out the switching of the valve operating mode in accurate timing measured based on time.

In stead of being carried out as the time-based process described above, the control process shown in FIG. 7 can be carried out as a TDC-based process in synchronism with generation of each pulse of the TDC signal. The pulse of the TDC signal is generated whenever the crankshaft rotates through a predetermined crank angle, and the repetition period of operation of the valve system varies with the rotational speed of the engine 3. Therefore, according to the TDC-based process, by measuring the switching delay period based on the rotational speed of the engine 3, the switching of the valve operating mode can be carried out in appropriate timing dependent on the repetition period of operation of the valve system.

The present invention is by no means limited to the preferred embodiment described above, but can be practiced in various forms. For example, although the above-described embodiment is an example of application of the present invention to a hybrid vehicle in which the engine 3 is directly connected to the motor 4, this is not limitative, but the present invention can be applied to other types of hybrid vehicles, and also to normal vehicles driven by the engine alone. Further, the variable valve-actuating mechanism 21 in the preferred embodiment is configured to be capable of switching the valve operating mode between three types: the normal mode, the retarded-closing mode, and the idle cylinder mode, this is not limitative, but it may be configured to be capable of switching the same between only two types or four or more types of the valve operating mode.

Further, although in the above-described embodiment, the degree of suppression of the valve operating mode is set as a delay time period from occurrence of the demand for the switching to the execution of the switching (switching delay value VTECCNTOK), this is not limitative, but the same can be set by other suitable means. Further, the map values shown in FIGS. 10 and 11 for setting the switching delay value VTECCNTOK are illustrated only by way of way of example, and they can be configured to any other suitable settings. For example, although in the FIG. 10 map, the acceleration-time map value MVTECCNTACC is set to the same value when the valve operating mode is switched to a lower output side and to a higher output side, it may be set to different values in the respective cases.

It is further understood by those skilled in the art that the foregoing is a preferred embodiment of the invention, and that various changes and modifications may be made without departing from the spirit and scope thereof.

What is claimed is:

1. A valve control system for an internal combustion engine, for controlling operation of a valve system including an intake valve and an exhaust valve, comprising:

a variable valve-actuating mechanism that is capable of selectively switching an operating mode of the valve system between a plurality of operating modes different in output characteristics;

operating mode switching-determining means for determining whether or on the operating mode of the valve system should be switched;

switching suppression means for suppressing execution of switching of the operating mode by said variable valve-actuating mechanism based on the determination by said operating mode switching-determining means;

load-detecting means for detecting load on the engine; and suppression degree-setting means for setting the degree of suppression of the switching of the operating mode by said switching suppression means depending on the detected load on the engine.

2. A valve control system as claimed in claim 1, wherein said suppression degree-setting means sets the degree of suppression of the switching as a delay time period over which the execution of the switching by said variable valve-actuating mechanism is delayed after said operating mode switching-determining means has determined that the operating mode should be switched, the valve control system further comprising delay time-measuring means for measuring the delay time period based on time.

3. A valve control system as claimed in claim 1, wherein said suppression degree-setting means sets the degree of suppression of the switching as a delay time period over which the execution of the switching by said variable valve-actuating mechanism is delayed after said operating mode switching-determining means has determined that the operating mode should be switched, the valve control system further comprising delay time-measuring means for measuring the delay time period based on a rotational speed of the engine.

4. A valve control system as claimed in claim 1, wherein when the degree of increase in the load on the engine is larger than a predetermined value, said suppression degree-setting means sets the degree of suppression of the switching to a smaller value when the operating mode is to be switched to an operating mode having higher output characteristics than when the operating mode is to be switched to an operating mode having lower output characteristics.

5. A valve control system as claimed in claim 2, wherein when the degree of increase in the load on the engine is larger than a predetermined value, said suppression degree-setting means sets the degree of suppression of the switching to a smaller value when the operating mode is to be switched to an operating mode having higher output characteristics than when the operating mode is to be switched to an operating mode having lower output characteristics.

6. A valve control system as claimed in claim 3, wherein when the degree of increase in the load on the engine is larger than a predetermined value, said suppression degree-setting means sets the degree of suppression of the switching to a smaller value when the operating mode is to be switched to an operating mode having higher output characteristics than when the operating mode is to be switched to an operating mode having lower output characteristics.

7. A valve control system as claimed to any of claims 1 to 6, wherein the plurality of operating modes include at least three operating modes.

8. A valve control system as claimed to any of claims 1 to 6, wherein the engine is installed on a hybrid vehicle together with an electric motor directly connected to the engine, and wherein the plurality of operating modes include an idle cylinder mode in which the valve system is made idle in a state of the hybrid vehicle being driven by the electric motor.

9. A valve control system as claimed in claim 7, wherein the engine is installed on a hybrid vehicle together with an electric motor directly connected to the engine, and wherein the plurality of operating modes include an idle cylinder mode in which the valve system is made idle in a state of the hybrid vehicle being driven by the electric motor.

* * * * *